US005429521A

United States Patent [19]

Morlion et al.

[11] Patent Number: 5,429,521

[45] Date of Patent: Jul. 4, 1995

[54] CONNECTOR ASSEMBLY FOR PRINTED CIRCUIT BOARDS

[75] Inventors: Danny Morlion, St. Amandsberg; Luc Jonckheere, Dilbeek, both of Belgium

[73] Assignee: Framatome Connectors International, Paris, France

[21] Appl. No.: 252,264

[22] Filed: Jun. 1, 1994

[30] Foreign Application Priority Data

Jun. 4, 1993 [NL] Netherlands ..... 9300971

[51] Int. Cl.[6] ..... H01R 13/648

[52] U.S. Cl. ..... 439/108; 439/608

[58] Field of Search ..... 439/101, 108, 608, 609

[56] References Cited

U.S. PATENT DOCUMENTS

| | | | |
|---|---|---|---|
| 5,046,960 | 9/1991 | Fedder | 439/108 |
| 5,102,353 | 4/1992 | Brunker | 439/608 |
| 5,169,324 | 12/1992 | Lemke et al. | 439/108 |
| 5,259,773 | 11/1993 | Champion et al. | 439/108 |
| 5,307,242 | 4/1994 | Seibold et al. | 439/108 |
| 5,356,301 | 10/1994 | Champion et al. | 439/108 |

FOREIGN PATENT DOCUMENTS

| | | |
|---|---|---|
| 0337634 | 10/1989 | European Pat. Off. . |
| 0374307 | 6/1990 | European Pat. Off. . |
| 0446980 | 9/1991 | European Pat. Off. . |

*Primary Examiner*—Gary F. Paumen
*Attorney, Agent, or Firm*—Perman & Green

[57] ABSTRACT

A connector assembly for printed circuit boards comprises a first and a second connector part. The first connector part has a first housing of insulating material and having a bottom and two opposite side walls and with male contact elements mounted in the bottom of the housing and arranged in rows and columns and having portions projecting from the bottom of the housing adapted to be inserted into holes of the corresponding printed circuit board. The second connector part has a second housing of insulating material adapted to be inserted into the first housing with an insertion side and with female contact elements mounted in the housing and arranged in a corresponding manner in rows and columns and having portions projecting from a lower side of the housing and adapted to be inserted into openings of the corresponding printed circuit board. A third housing is provided substantially corresponding with the first housing and adapted to be fixed with its bottom on the male contact elements of teh first connector part after mounting said first connector part on the corresponding printed circuit board. In the second housing at least one ground contact plate unit with a cross-shaped cross section is provided, dividing said housing in quadrants with a mutually equal plurality, preferably four, of female contact elements, wherein the ground contact plate unit at the insertion side of the second housing projects from this housing along a distance substantially corresponding with the thickness of the bottom of the first and third housings, respectively. A cross-shaped slot is provided in the bottom of the first and third housings for receiving the ground contact plate unit, said slot dividing the bottom of the housing in quadrants with said plurality of male contact elements.

11 Claims, 10 Drawing Sheets

CONNECTOR ASSEMBLY FOR PRINTED CIRCUIT BOARDS

BACKGROUND OF THE INVENTION

The invention relates to a connector assembly for printed circuit boards, comprising a first connector part with a first housing of insulating material and having a bottom and two opposite side walls and with male contact elements mounted in the bottom of the housing and arranged in rows and columns and having portions projecting form the bottom of the housing, which projecting portions can be inserted into holes of the corresponding printed circuit boards, and a second connector part with a second housing of insulating material and adapted to be inserted into the first housing with an insertion side and with female contact elements mounted in the housing and arranged in a corresponding manner in rows and columns and having portions projecting from a lower side of the housing, which projection portions can be inserted into holes of the corresponding printed circuit board.

Such a connector assembly is disclosed for example in EP-A-0 446 980. In this known connector assembly the second connector part comprises a plurality of outer conductors each substantially enclosing in circumferential direction at least one female contact element operating as signal contact and each contacting the adjacent ground contacts of the corresponding signal contact of the first connector part. In this manner a correct signal transmission can be obtained also at high bit rates of the signals to be transmitted. Further, outer conductors can also be provided in this known connector assembly for the male contact elements operating as signal contacts. Although an optimal signal transmission can be realized with this known connector assembly also at high bit rates, the construction is less suitable for applications, wherein the signal contacts must be very closely spaced one from the other.

SUMMARY OF THE INVENTION

The invention aims to provide a connector assembly of the abovementioned type, wherein an optimal signal transmission at high bit rates is possible, wherein the signal contacts can be closely spaced and by means of which the printed circuit boards can be connected to a central printed circuit board on both sides.

To this end a third housing is added to the connector assembly according to the invention, which can be fixed with its bottom to the male contact elements of the first connector part after mounting said first connector part on the corresponding printed circuit board, in the second housing at least one cross-shaped ground contact plate unit in cross section being provided, dividing said housing in quadrants with a mutually equal plurality, preferably four, of female contact elements, wherein the ground contact plate unit at the housing along a distance substantially corresponding with the thickness of the bottom of the first and third housings, respectively, and in that a cross-shaped slot is provided in the bottom of the first and third housings for receiving the ground contact plate unit, said slot dividing the bottom of the housing in quadrants with said plurality of male contact elements.

In this manner a connector assembly is obtained, with which on both sides printed circuit boards can be connected with a central printed circuit board, the ground contact plate unit of the relative second connector parts in the coupled position also ensuring a shielding in the first and third housing.

BRIEF DESCRIPTION OF THE DRAWINGS

The invention will be further explained with reference to the drawings, in which some embodiments of the connector assembly according to the invention are shown.

FIG. 3 is a top view of the first housing of the first connector part of FIG. 2.

DETAILED DESCRIPTION OF THE PREFERRED EMBODIMENTS

Figure 1:
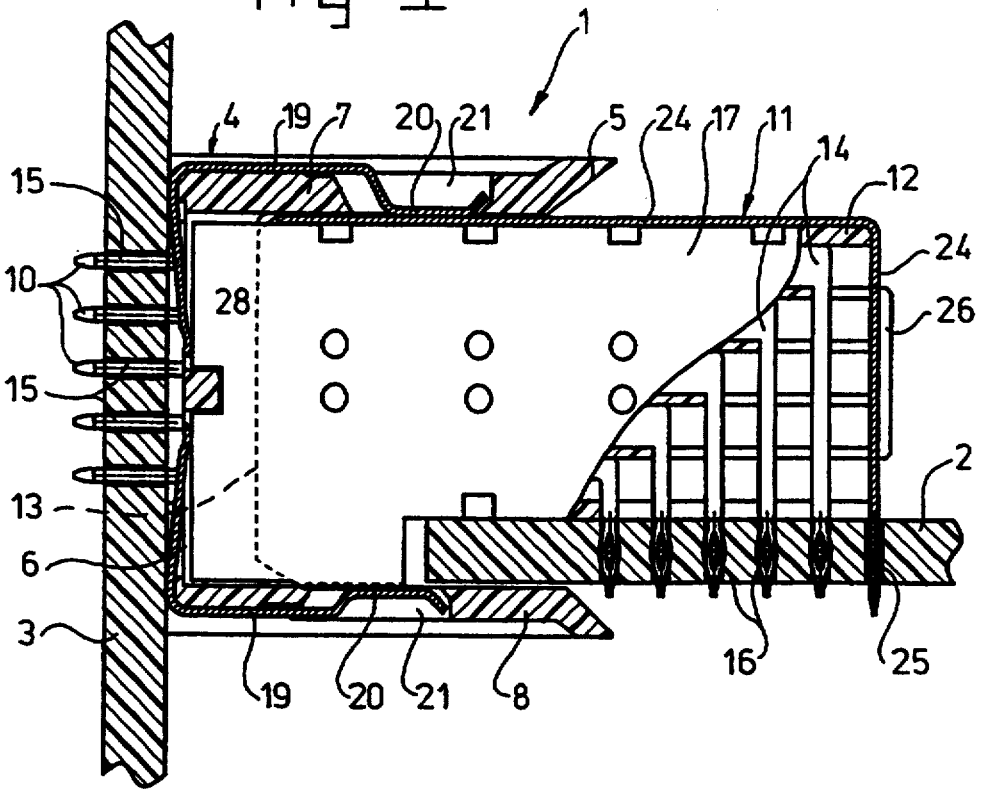
FIG. 1 is a side view, partially in cross section and partially broken away, of a first embodiment of the connector assembly according to the invention in the coupled position.
Figure 2:
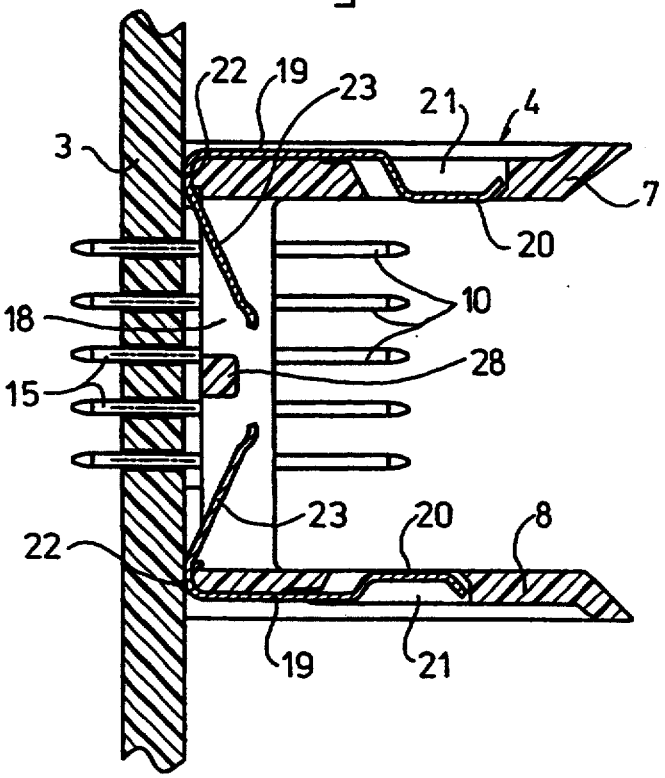
FIG. 2 is a cross section of the first connector part of the connector assembly of FIG. 1.

FIG. 1 shows a side view, partially in cross section and partially exploded, of a connector assembly 1 for connecting a printed circuit board 2 to a printed circuit board 3 generally indicated as back panel. A first connector part 4, shown in cross section in FIG. 2, is mounted on the printed circuit board 3. The connector part 4 comprises a housing 5 of insulating material, a top view of which is shown in FIG. 3, with a bottom 6 and two opposite side walls 7 and 8, respectively. In the bottom 6 openings 9 are formed, in which contact pins 10 operating as male contact elements are fixed. The contact pins 10 are arranged in rows and columns, wherein in the embodiment shown six columns each having five contact pins 10 are provided. According to the cross section of FIG. 2 and the top view of FIG. 3, respectively, each column of contact pins includes four signal contact pins being divided into two pairs by a central ground contact pin. the distance between the contact pins 10 in row direction is 2 mm in the embodiment shown, so that one pair of signal contacts is provided per mm. In this manner each pair of signal contact pins can transmit one pair of different signals.

If desired it is also possible to apply a higher number of rows and columns of contact pins 10. It is further possible that the columns of contact pins comprise alternatingly a signal contact pin and a ground contact pin, other arrangements of signal and ground contact pins or even signal contact pins only.

The connector assembly 1 further comprises a second connector part 11 with a second, housing 12 of insulating material. This second housing 12 is inserted into the first housing 5 with an insertion side 13. Female contact elements 14 arranged in the same manner as the contact pins 10 are mounted in the second housing 12, said contact elements engaging the contact pins 10 in the inserted position of FIG. 1 in a manner known per se. As appears from the cross-sections of FIGS. 1 and 2, both the contact pins 10 and the female contact elements 14 are provided with portions 15 and 16, respectively, being fixed in so-called plated through holes of the printed circuit boards 3 and 2, respectively, by insertion.

The second connector part 11 comprises a ground contact plate 17 on both sides of each column of female contact elements 14, said ground contact plates 17 projecting out of the housing 12 at the insertion side 13 along a distance substantially corresponding with the thickness of the bottom 6 of the housing 5. For receiving these projecting parts of the ground contact plates 17 the bottom 6 of the housing 5 is provided with slots 18.

Figure 5:
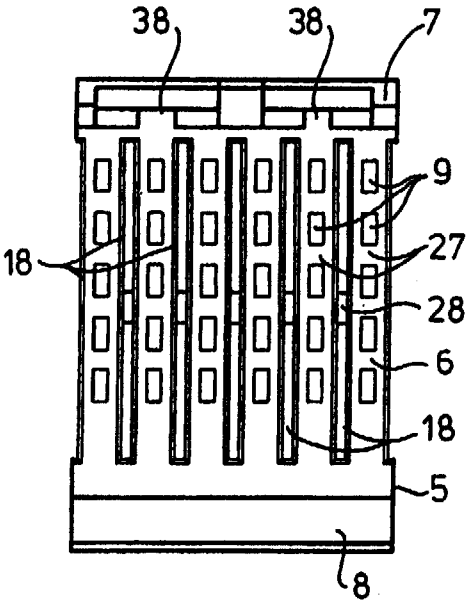
FIG. 5 is a perspective and partially exploded view of the second connector part of the connector assembly of FIG. 4.
Figure 5:
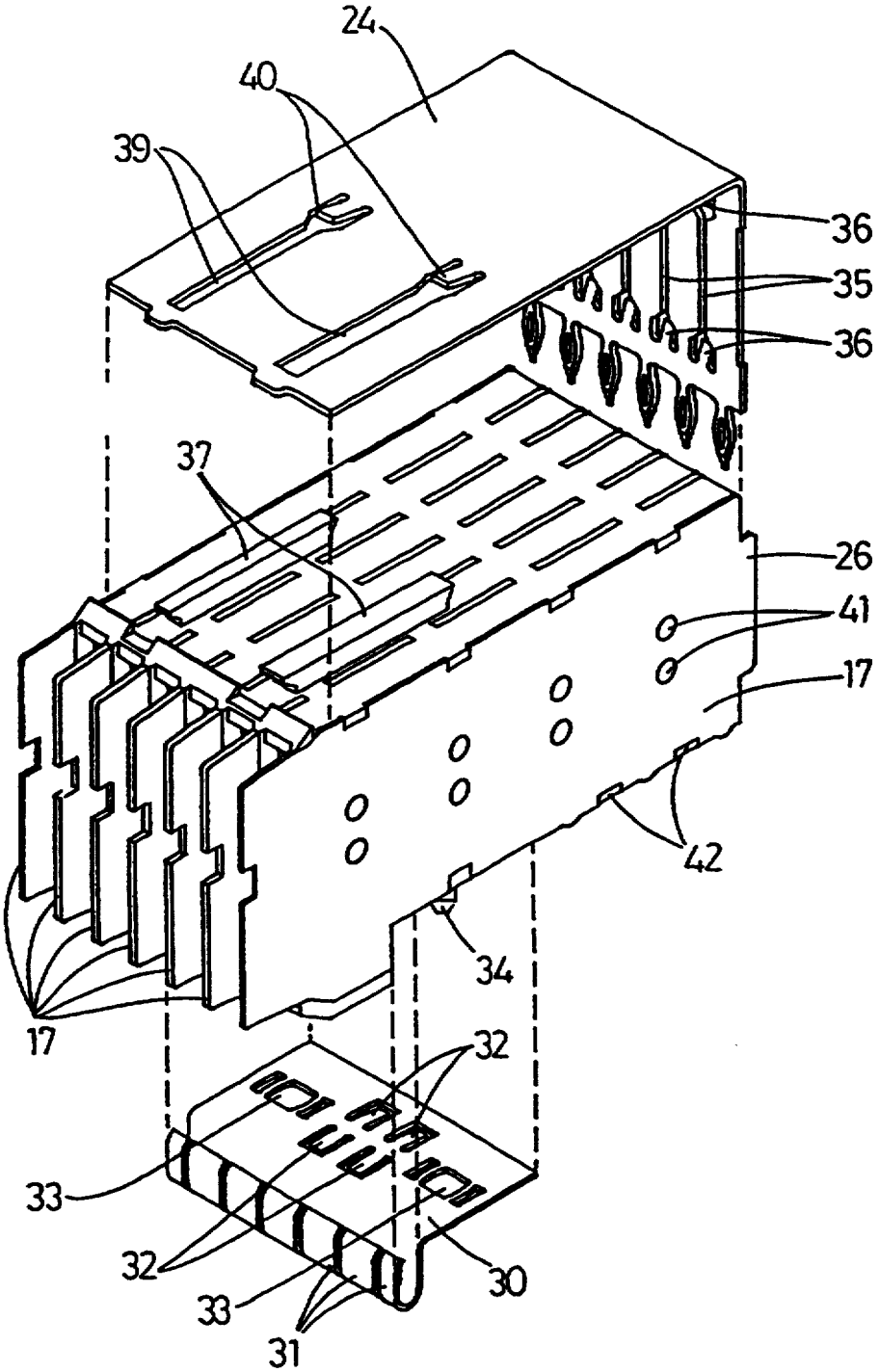

In this manner it is obtained that the shielding of each column of contact elements 14 of the second connector part 11 also forms a shielding between the columns of contact pins 10 of the first connector part 4 in the coupled position of the connector assembly 1. The ground contact plates 17 can include suitable contact elements at the edge directed towards the printed circuit board 2, said contact elements contacting for example a ground contact conductor layer at the surface of the printed circuit board 2. These contact elements are indicated in FIG. 5 by reference numeral 17'. Of course, it is also possible to provide the ground contact plates 17 with insertion contact portions.

The first connector part 4 comprises shielding plates 19 mounted on the side walls 7, 8 of the first housing 5. These shielding plates 19 are provided with contact springs 20 projecting into the housing 5 through openings 21 in the side walls 7, 8. Further, the shielding plates 19 have contact areas 22 contacting a suitable conductor on the surface of the printed circuit board 3. In the embodiment shown in FIG. 1, the shielding plates 19 further include contact springs 23 projecting into the slots 18 of the housing 5 and contacting the ground contact plates 17 in the coupled position of the connector assembly 1. The contact springs 20 of the shielding plate 19 on the side wall 8 are contacting the edges of the ground contact plates 17.

The connector part 11 further comprises a shielding plate 24 being mainly L-shaped, wherein the short leg extends along the back side of the housing 12 and the long leg extends along the upper side of the housing. The short leg of the shielding plate 24 includes contact parts 25 inserted into openings of the printed circuit board 2 and contacting a corresponding conductor of the printed circuit board 2. In the inserted position of FIG. 1, the contact springs 20 of the shielding plate 19 of the side wall 7 are contacting the shielding plate 24. It is possible to provide the ground contact plates 17 and/or the shielding plate 24 of suitable contact means ensuring a good connection between the shielding plate 24 and the ground contact plates 17. As an alternative the ground contact plates 17 and the shielding plate 24 cannot be in contact with each other with the exception of a contact between the shielding plate 24 and an extension 26 of each ground contact plate 17. As shown in FIG. 1, the extensions 26 project at the back side out of the housing 12 and project through slots in the short leg of shielding plate 24, not visible in FIG. 1, where the extensions 26 contact the shielding plate 24.

As appears from FIGS. 2 and 3, the parts 27 of the bottom 6 between the slots 18 are mutually connected by a web 28 to strengthen the bottom 6.

Figure 4:
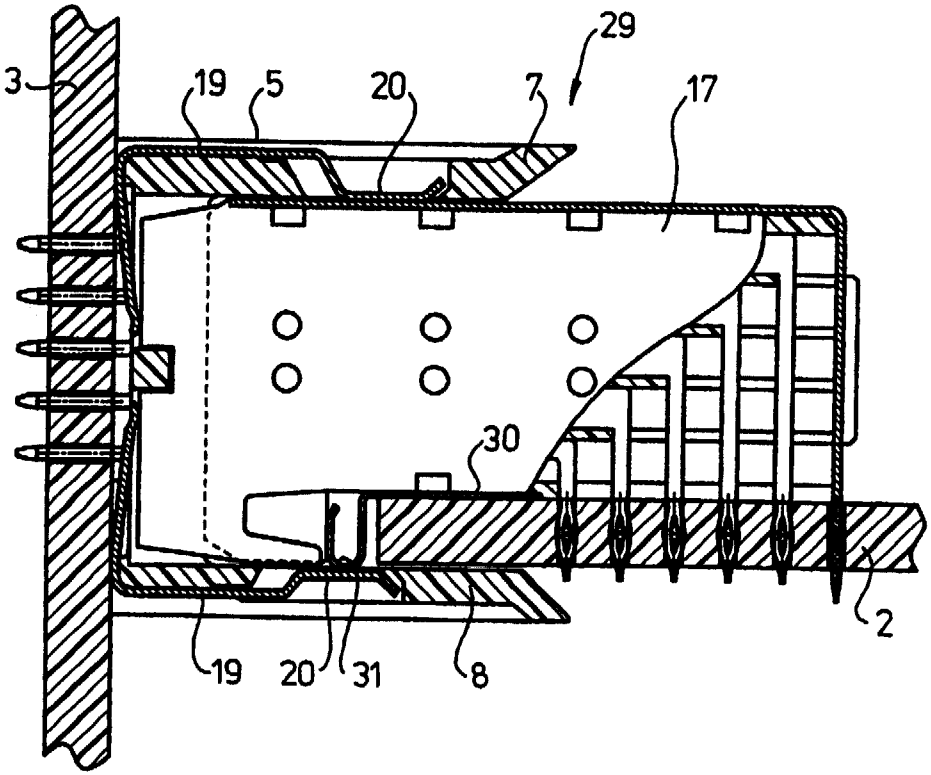
FIG. 4 is a side view, partially in cross section and partially broken away, of a second embodiment of the connector assembly according to the invention in the coupled position.

FIG. 4 shows a connector assembly 29 being mainly made in the same manner as the connector assembly 1 of FIG. 1. Corresponding parts are indicated with the same reference numerals. In the connector assembly 1 of FIG. 1 the contact springs 20 of the shielding plate 19 at the side wall 8 of the housing 5 are contacting the edges of the ground contact plates 17, wherein for a good long term operation a special machining of these edges of the ground contact plates 17 would be desirable. In the connector assembly 29 a contact between the edges of the ground contact plates 17 and the contact springs 20 is obviated by means of a connection plate 30 with arcuate contact means 31, said connection plate 30 being attached at the lower side of the connector part 11. These arcuate contact means 31 are contacting the contact springs 20 of the shielding plate 19 in the coupled position of the connector assembly 29. The connection plate 30 in its position mounted on the printed circuit board 2, is connected with a corresponding conductor of the printed circuit board 2 and is also contacting the ground contact plates 17.

The connector part 11 of the connector assembly 29 is shown in a perspective view in FIG. 5, wherein the shielding plate 19 and the connection plate 30 are shown separated from the housing 12. FIG. 5 shows that the connection plate 30 is provided with contact elements 32 ensuring a good connection with a conductor on the surface of the printed circuit board 2. Further, the connection plate 30 includes openings 33 for the attachment of the connection plate on the housing 12 by means of lugs 34, only one of which being visible in FIG. 5.

It can further be seen in FIG. 5 that the shielding plate 24 has slots 35 for the extensions 26 of the ground contact plates 17 in the part on the back side of the housing 12. On both sides of each slot 35 there is a contact lip 36 engaging the extension 26.

At the upper side of the housing 12 two positioning lugs 37 are provided co-operating with slots 38 in the side wall 7 of the housing 5 of the first connector part 4, so that the connector part 11 can be inserted into the connector part 4 in one position only. The shielding plate 24 has two slots 39, in which the lugs 37 are received. Lips 40 are formed for engaging under a protruding park of the lugs 37 to hold the shielding plate 24 on the housing 12.

It is noted that the ground contact plates 7 are mounted in the housing 12 during injection moulding. The ground contact plates 17 are supported in the mould for making the housing 12 and are provided with openings 41, 42 filled with the insulating material of the housing 12, whereby the ground contact plates 17 are anchored well in the housing 12.

As shown in FIGS. 3 and 5, the outer slots 18 and ground contact plates 17, respectively, have a dimension and row direction, which is half of the corresponding dimension of the remaining slots 18 and ground contact plates 17. In this manner a plurality of connector parts 4 and 11, respectively, can be located one next to the other, wherein the distance between the successive columns of contact pins 10 and contact elements 14 is maintained also in case of two connector parts located one next to the other.

Figure 6:
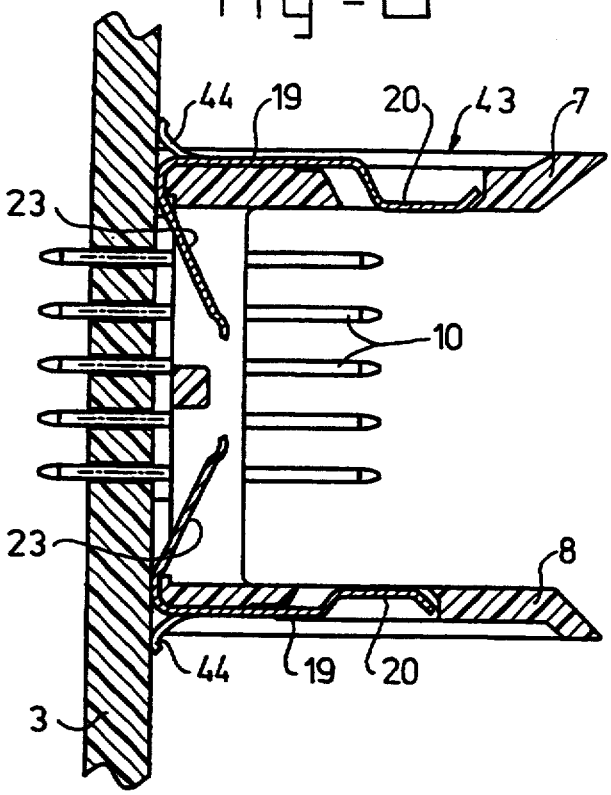
FIG. 6 is a cross section corresponding with FIG. 2 and showing an alternative embodiment of the first connector part.

FIG. 6 shows a cross section of a first connector part 43 being mainly made in the same manner as the connector part 4. Corresponding parts are indicated with the same reference numerals. In this case the shielding plates 19 are provided with further contact tongues 44 connected with a conductor of the printed circuit board 3 by soldering or another suitable connecting technique.

Figure 7:
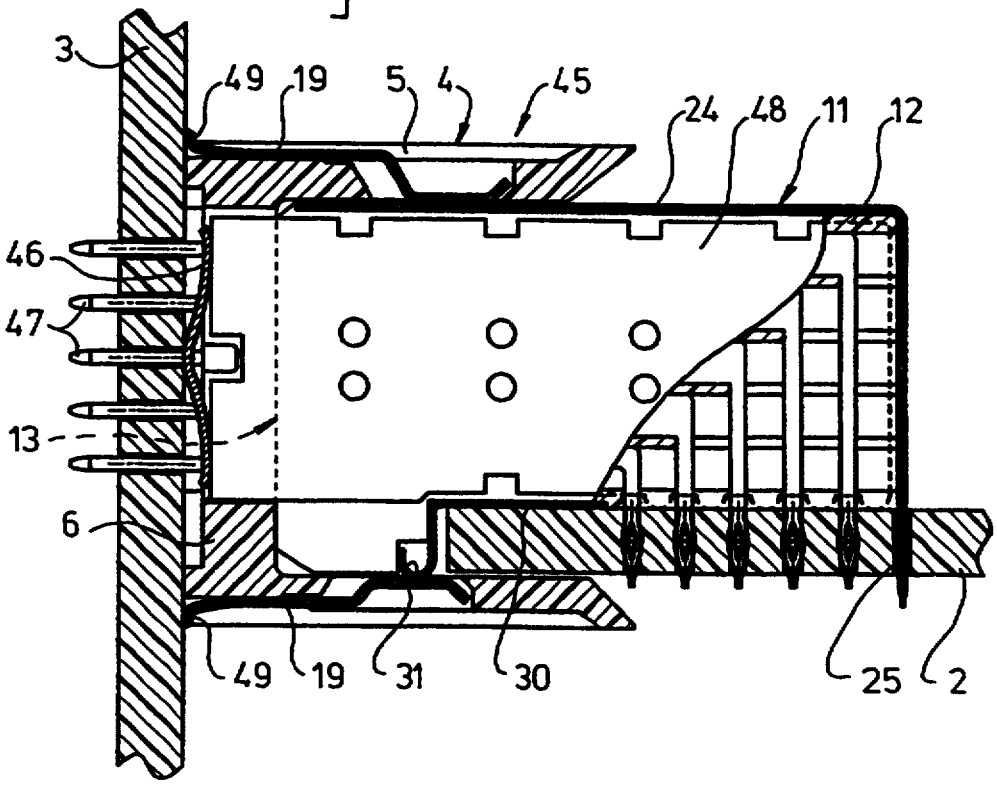
FIG. 7 is a side view, partially in cross section and partially broken away, of a third embodiment of the connector assembly according to the invention in the coupled position.
Figure 8:
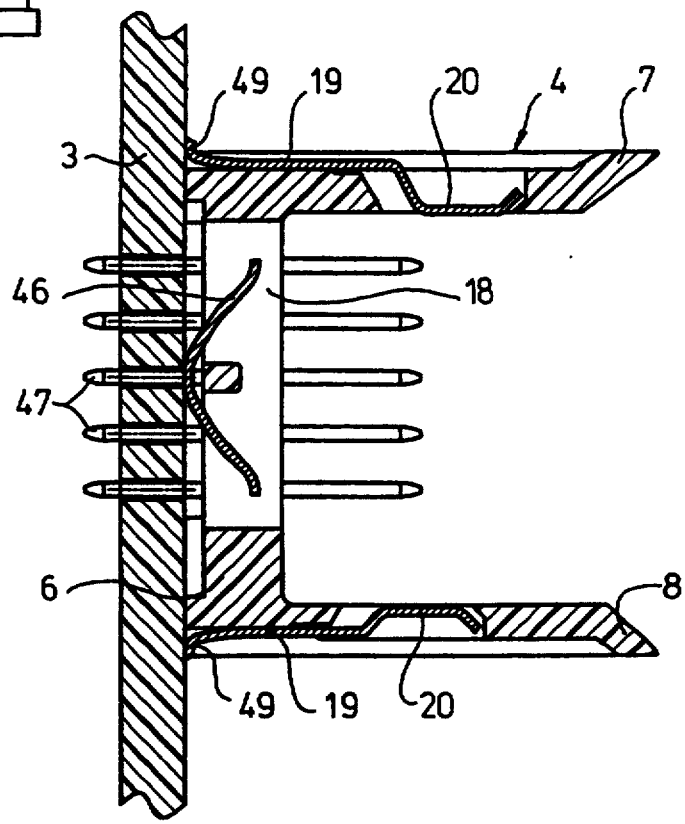
FIG. 8 is a cross-section of the first connector part of the connector assembly of FIG. 7.

In the embodiments of the connector assembly according to the invention as shown in FIGS. 1–6, the ground contact plates 17 are connected with the shielding plates 19, 24. For certain applications it can be desirable to make no connection between the shielding and the ground contact plates. FIG. 7 shows a connector assembly 45, wherein a separation is established between the shielding and the ground contact plates. For the remaining part this embodiment corresponds with the above described embodiments, wherein corresponding parts are indicated with the same reference numerals. FIG. 8 shows the first connector part 4 of the connector assembly 45 in cross section.

In this case the first connector part 4 is provided with a contact spring element 46 in each slot 18 in the bottom 6, said contact spring element 46 being connected with a ground conductor of the printed circuit board 3 by means of a contact pin 47. The contact pins 47 are aligned with the row of ground contact pins 10. In the inserted position these contact springs 46 are contacting the ground contact plates 48 being mainly made in the same manner as the ground contact plates 17. Also in this case the ground contact plates 48 are projecting out of the housing at the insertion side 13 of the housing 12 and are received in the slots 18 of the bottom 6 of the housing 5 in the coupled position of the connector assembly 45. The ground contact plates 48 are, however, shorter than the ground contact plates 17 so that they do not contact the shielding plate 24 of the second connector part 11. Further, the shielding plates 19 of the first connector part 4 are in this case of course made without the contact springs 23. The shielding plates 19 have contact tongues 49 which are connected with a shielding conductor of the printed circuit board 3. Of course, the connection plate 30 of the second connector part 11 is not contacting the ground contact plates 48 in this case.

Figure 9:
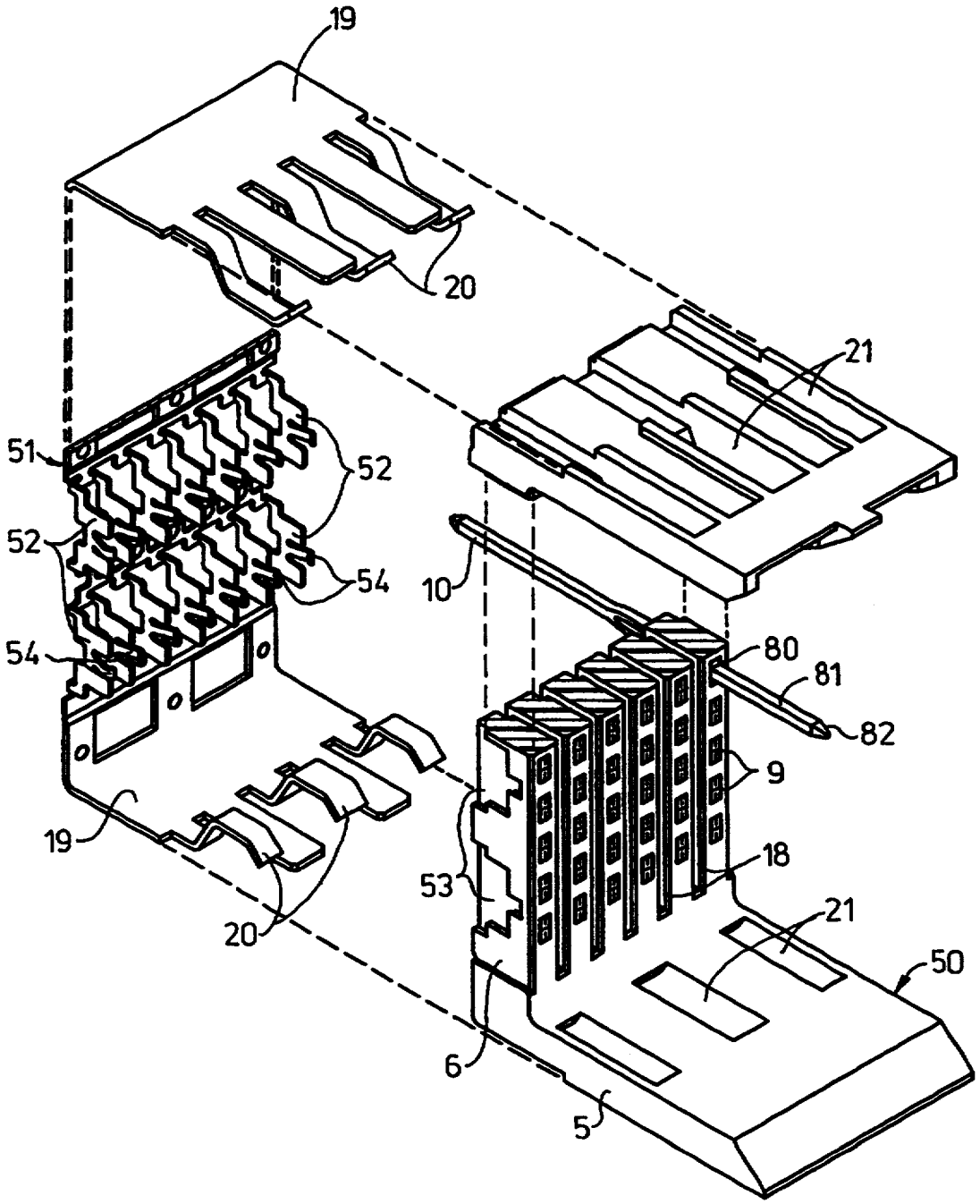
FIG. 9 is a perspective view, partially exploded and partially broken away, of an alternative embodiment of the first connector part of the connector assembly according to the invention.

FIG. 9 shows a perspective view of a first connector part 50 being mainly made in thee same manner as the first connector parts 4 and 43, respectively. Corresponding parts are indicated by the same reference numerals. In this case the connector part 50 is provided with a ground contact unit 51 having two ground contact plates 52 for each slot 18 in the bottom 6 of the housing 5, which ground contact plates 52 are received in a recess 53 adjacent to the corresponding slot 18. Each ground contact plate 52 includes a contact spring 53 projecting into the corresponding slot 18 and contacting the corresponding ground contact plate 17 in the coupled position of the connector assembly. Each ground contact plate 52 has mainly a H-shape wherein the legs of the H-shape are aligned with the rows of signal contact pins 10.

In the embodiment of FIG. 9 the ground contact unit 51 is unitary with the shielding plates 19 so that when using the connector part 50 a connection is made between the ground contact plates 17 and the shielding plates 19, 24. If a separation is desired between shielding and grounding, it is possible to keep the ground contact unit 51 separated from the shielding plates 19, wherein in that case the ground contact unit 51 is provided with one or more suitable ground contact means.

The application of the ground contact unit 51 has the advantage that in a restricted decoupled position caused by tolerances in the mounting system, in which the connector assembly and the corresponding printed circuit boards are accommodated, an optimal ground shielding is guaranteed between the columns of contact pins 10. Moreover, a good long term connection between the ground contact unit 51 and the ground contact plates 17 is guaranteed by the contact springs 54 engaging the surface of the ground contact plates 17.

It is noted that only one contact pin 10 is shown in FIG. 9 for illustration purposes. However, it will be clear that all openings 9 in the bottom 6 of the housing 5 are provided with contact pins 10.

Although in the above described embodiments a ground contact plate is provided at each side of each column of female contact elements, it is also possible that more than one column of contact elements is provided between each two ground contact plates.

Figure 10:
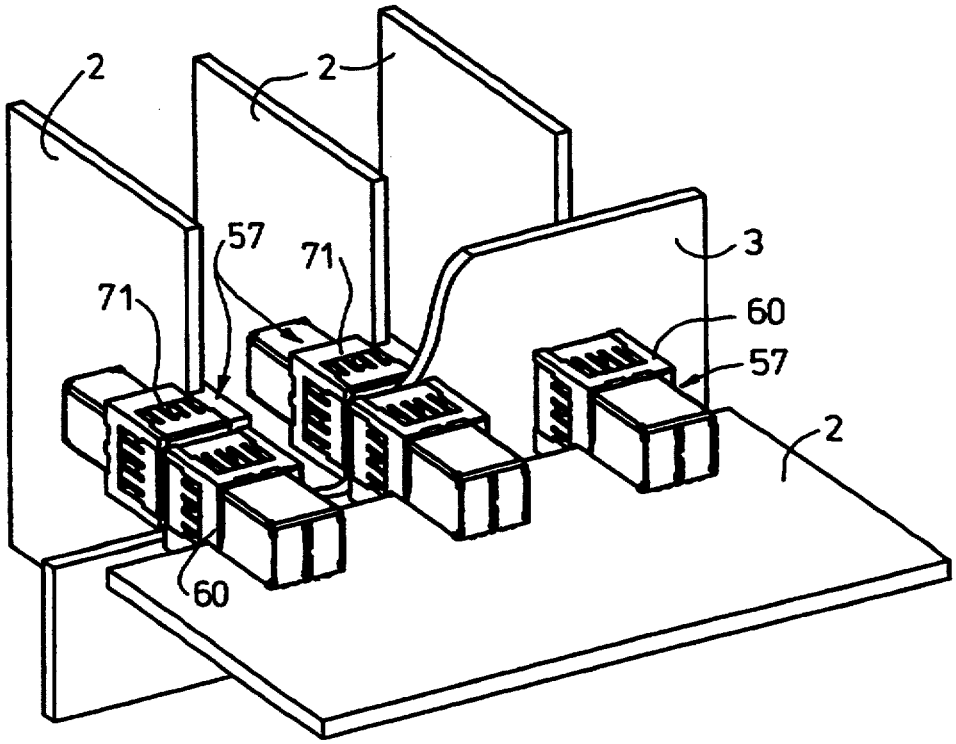
FIG. 10 is a perspective view of a fourth embodiment of the connector assembly according to the invention for connecting printed circuit boards on both sides of a central printed circuit board.

FIG. 10 schematically shows in a perspective view a plurality of printed circuit boards 2 connected to the central printed circuit board or back panel 3. The printed circuit boards 2 at the one side of the printed circuit board 3 extend perpendicular to the printed circuit boards 2 at the other side of the printed circuit board 3. For connecting various conductors of the printed circuit boards 2, 3 connector assemblies 57 are used which are mainly made in a comparable manner as the above-described connector assemblies. In FIGS. 11–14 both connector parts of the connector assembly 57 are shown in more detail and in FIGS. 15–18 both connector parts of an alternative embodiment of the connector assembly 57 are shown.

Figure 11:
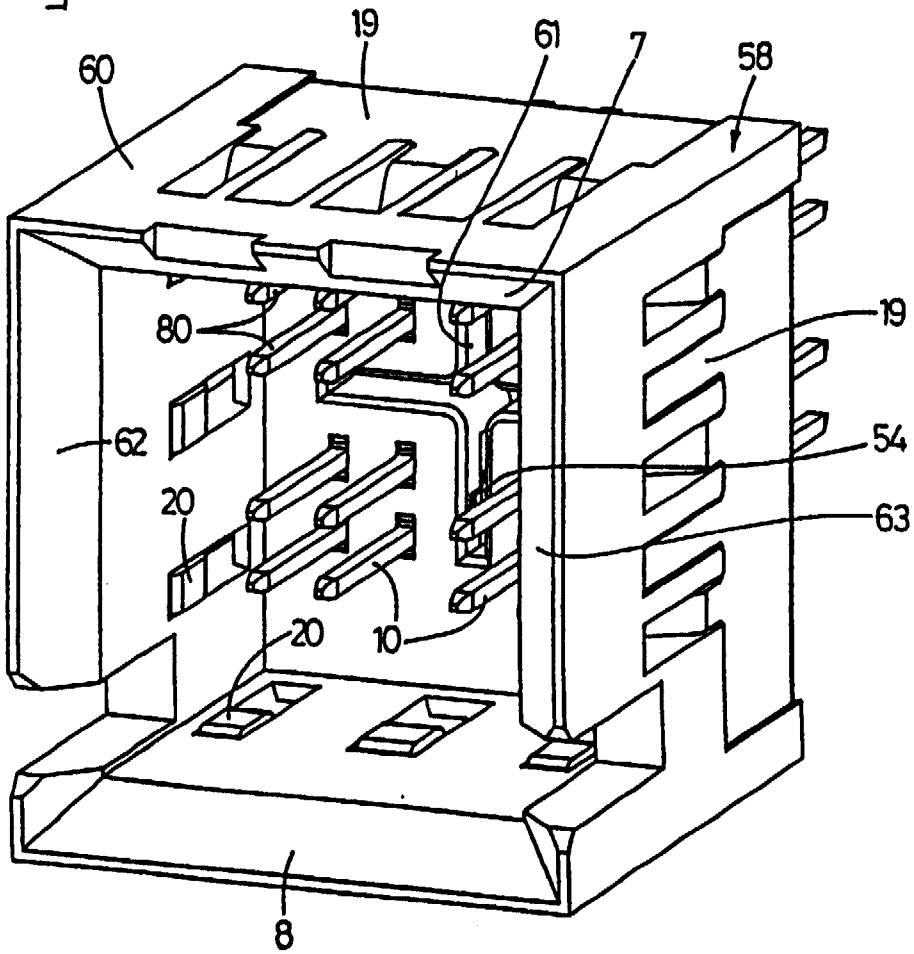
FIG. 11 is a perspective view of a first connector part adapted to be used in the connector assembly of FIG. 10.
Figure 13:
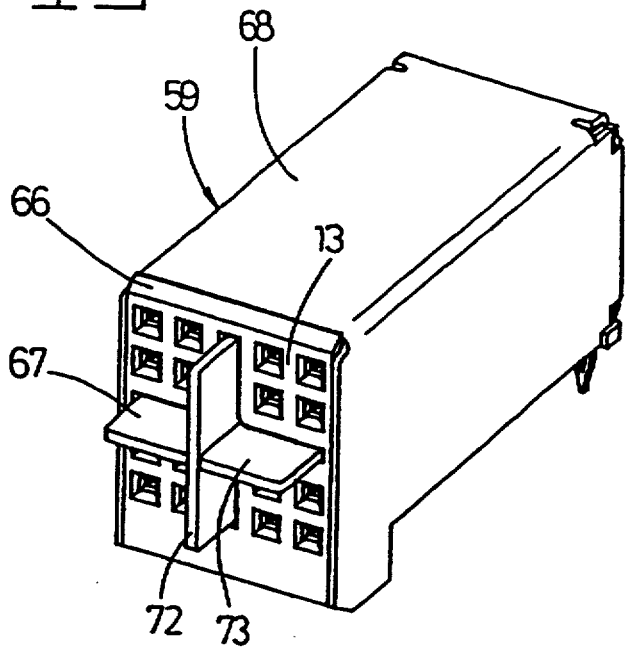
FIGS. 13 and 14 show perspective views of a second connector part adapted to be used in the connector assembly of FIG. 10.
Figure 14:
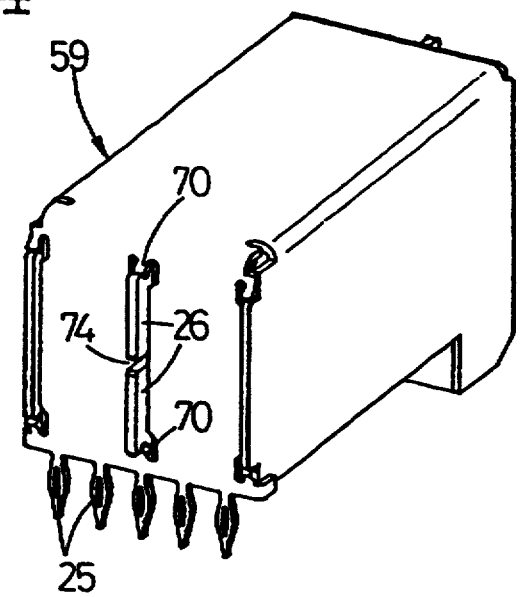

The connector assembly 57 comprises a first connector part 58 shown in FIG. 11, and a second connector part 59 shown in FIGS. 13, 14. The first connector part 58 comprises a housing 60, in which four groups each having four contact pins 10 are provided. The groups of contact pins 10 are separated from each other by a mainly cross-shaped slot 61 in the bottom 6 of the housing 60. The contact pins 10 actually are arranged in rows and columns as well as in the above described embodiments, wherein in this case the central row and central column are not provided and at their location the cross-shaped slot 61 is provided. This slot 61 divides the bottom 6 of the housing 60 into four quadrants each including four contact pins 10 in this embodiment. It is also possible to have a different number of rows and columns, so that each quadrant includes a different number of .contact pins 10.

Figure 12:
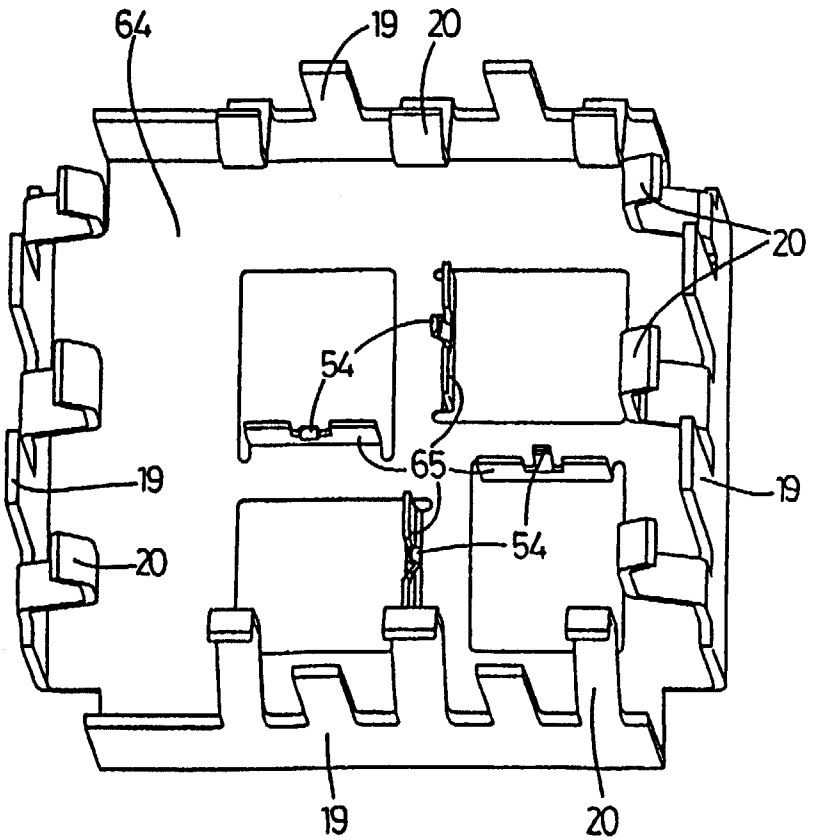
FIG. 12 is a perspective view of a component of the first connector part of FIG. 11.

In this case the side walls 7, 8 of the housing 60 are interconnected by further side walls 62, 63 so that a receiving space for the second connector part 59 closed all around is obtained. Each side wall 7, 8, 62, 63 is provided with a shielding plate 19, contract springs 20 of which project into the housing 60 through openings. As shown in FIG. 12 the shielding plates 19 are part of a ground contact unit 64 in this embodiment of the connector part 58, wherein the ground contact unit 64 comprises ground contact plates 65 with contact springs 54. In FIG. 11 just two contact springs 54 in the slot 61 are visible. It will be clear that the ground contact plates 65 are received in recesses adjacent to the slot 61 in the same manner as the ground contact plates 52.

The second connector part 59 comprises a housing 66, in which a ground contact plate unit 67 is mounted, having a cross-shaped cross section. In the same manner as in the earlier described contact assemblies, the ground contact plate unit 67 projects out of the housing at the insertion side 13 of the housing 66, which projecting part is received in the slot 61 of the housing 60 of the first connector part 58 in the coupled position. At its upper side, back side and both side walls the housing is enclosed by a shielding plate 68 contacting the contact springs 20 of the shielding plates 19 in the inserted position. In the part of the shielding plate 68 located on the back side of the housing 66 a slot is provided, in which an extension 26 of the ground contact plate unit 67 is received and is held in the same by contact tongues 70. At the lower side of the housing 66 a connection plate 30 with arcuate contact means 31 is mounted in the same manner as at the connector assembly of FIG. 4. The contact means 31 are not visible in FIGS. 13 and 14.

Each group of four contact pins 10 and each group of four female contact elements not shown in FIGS. 13, 14 comprises two contact pins/contact elements diagonally opposite each other suitable for different signals.

The connector assembly 57 further comprises a third housing 71 mainly corresponding with the housing 60 of the first connector part 58. this housing 71 is attached with bottom on the contact pins 10 of the first connector part 58, after having mounted this first connector part 58 on the printed circuit board 2. This housing 71 with its corresponding components forms a first connector part at the opposite side of the printed circuit board 2, wherein a second connector part 59 can be inserted into this connector part in the same manner as in the connector part 58.

It is noted that the ground contact plate unit 67 of the second connector part 59 according to FIGS. 13, 14 is composed of two flat plates 72, 73 each having a slot 74, only one of which can be seen in FIG. 14. The plates 72, 73 are slided into each other with their slots 74 to obtain the ground contact plate unit 67. The extension 26 of the plate 72 is divided into two halves by the slot 74.

In FIGS. 15–18 the first connector part 75 and the second connector part 76 are shown forming together a connector assembly corresponding with the connector assembly 57. The connector parts 75, 76 mainly correspond with the connector parts 58, 59. Corresponding parts are indicated by the same reference numerals.

Figure 16:
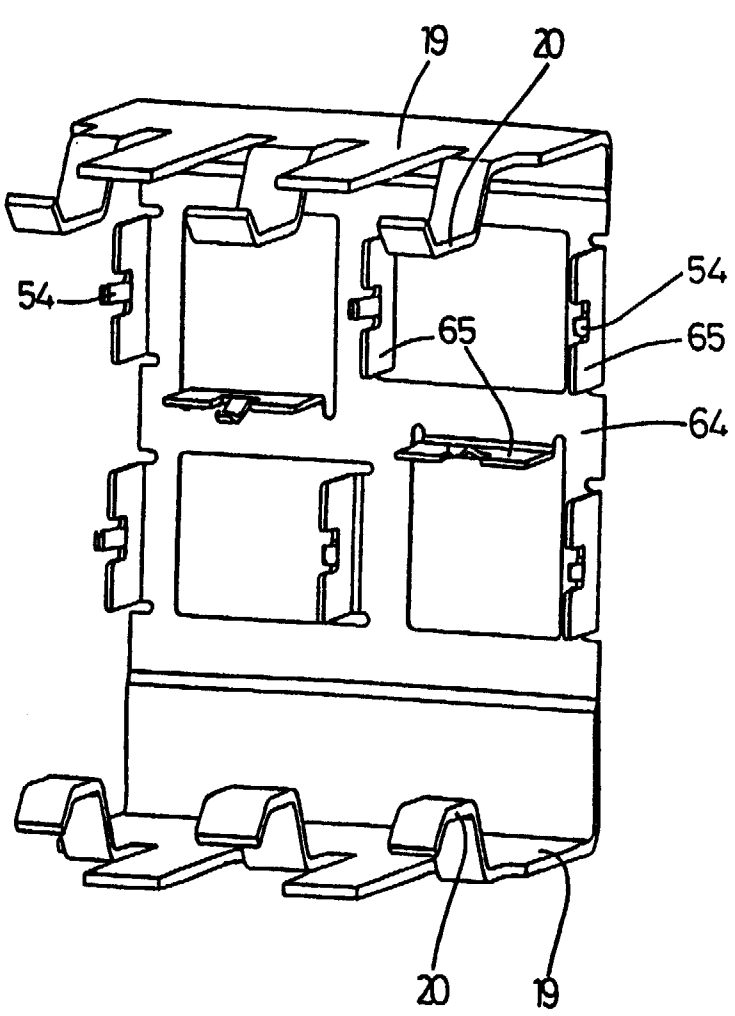
FIG. 16 shows a component of the first connector part of FIG. 15.
Figure 15:
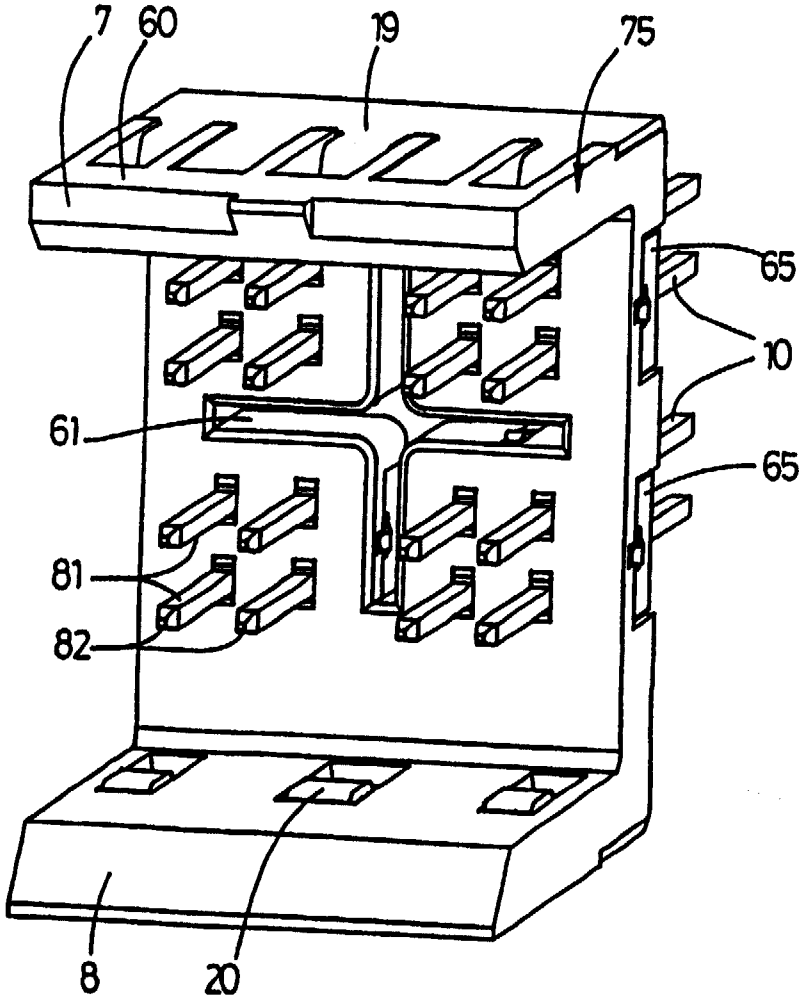
FIG. 15 is a perspective view of a second embodiment of the first connector part adapted to be used in the connector assembly of FIG. 10.

In this case the connector part 75 comprises a housing made without the side walls 62, 63. In order to obtain a good shielding at the respective sides of the bottom 6 of the housing 60, the ground contact unit 64 comprises further ground contact plates 65 with contact springs 54 at these sides as can be seen in FIG. 16 in particular. Further, the side wall parts of the shielding plate 68 of the second connector part 76 comprise extensions 77 in this case enclosing the open sides of the housing 60. The ground contact plate unit 67 projects out of the insertion side 13 of the housing 66 in the same manner as at the connector part 59. In this case the ground contact unit 67 is composed of two mutually equal ground contact plates 78 each bent along an angle of 90°. Each ground contact plate 78 has an extension 79 projecting at the back side through the slot of the shielding plate 68 and held in the same by the corresponding contact tongue 70.

Figure 17:
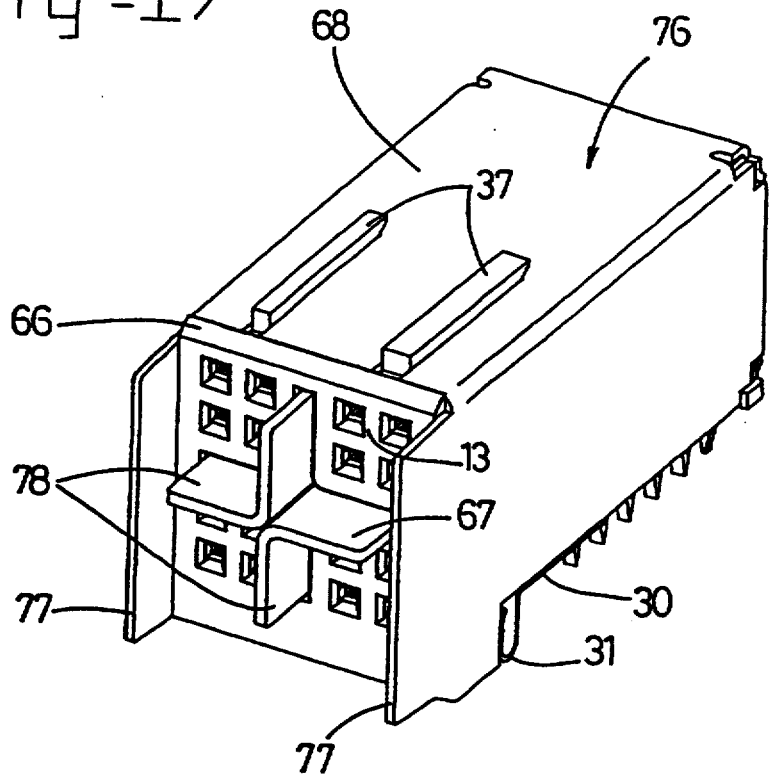
FIGS. 17 and 18 show perspective views of a second embodiment of the second connector part adapted to be used in the connector assembly of FIG. 10 with the first connector part of FIG. 15.
Figure 18:
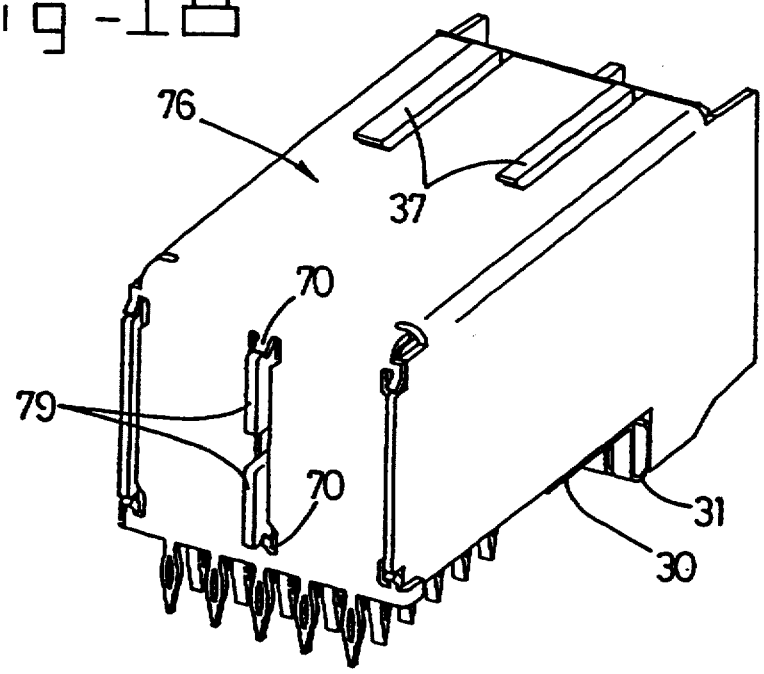

FIGS. 17 and 18 show the connection plate 30 with the arcuate contact means 31.

It is noted that in the embodiments of the connector assembly of FIGS. 10–18 the ground contact unit 64 is contacting the shielding plates 19, 68. However, in this case just as in the earlier described embodiments, it is also possible to separate grounding and shielding. To this end the shielding plates 19 are not formed as a part of the ground contact unit 64.

It is noted that the contact pins 10 each are provided with a shoulder 80 projecting at both sides of the contact pin, an upper surface of which can be seen in FIG. 9. Because the contact pins 10 in the described contact assemblies are mounted at a pitch of only 2 mm and the slots 18 and 61, respectively, are provided between the columns of contact pins, it is not possible to mount the contact pins 10 with their shoulders aligned with the row direction as usual up till now. In the described connector assemblies the shoulders 80 are directed into column direction as shown in FIGS. 3, 9, 11 and 15. Thereby the contact surfaces 81 of the contact pin parts 82 projecting into the housing, which are extending parallel to the shoulders 80 in the conventional contact pins, would also extend into column direction. At the application of the usual female contact elements, these female contact elements would not cooperate anymore with the contact surfaces 81 of the contact pins 10. In the connector assembly according to the invention contact pins are therefore used in the first connector part having a contact pin part 82 twisted along 90° with respect to the remaining contact pin part. In this manner it is obtained that the contact surfaces 81 extend in row direction so that they are contacting the female contact elements in the correct manner. These contact pins 10 with twisted contact pin part 82 are also advantageously used in the connector assemblies according to FIGS. 10–18. Thereby it is obtained that the contact surfaces of the contact pins 10 are extending into the correct direction at both sides of the printed circuit board 2.

A suitable method for manufacturing the contact pins with a twisted contact pin part is described in a patent application of the applicant of the same date.

Although the invention is explained above with reference to an application as connector assembly for printed circuit boards, the invention can also be applied in case of other types of connector assemblies, e.g. a cable connector.

The invention is not restricted to the above described embodiments, which can be varied in a number of ways within the scope of the claims.

What is claimed is:

1. Connector assembly comprising:

a first connector part with a first housing of insulating material having a bottom and two opposite side walls, and with male contact elements mounted in the bottom of the first housing and arranged in rows and columns, the male contact elements having first portions projecting from the bottom of the first housing, which first projecting portions can be inserted into holes of a corresponding first printed circuit board, a second connector part with a second housing of insulating material adapted to be inserted into the first housing with an insertion side, and with female contact elements mounted in the second housing and arranged in a corresponding manner in rows and columns, the female contact elements having second portions projecting from a lower side of the second housing, which projecting portions can be inserted into holes of a corresponding second printed circuit board, wherein a third housing is provided, substantially corresponding with the first housing, which is adapted to be fixed with a bottom of the third housing on the male contact elements of the first connector part after mounting said first connector part on the corresponding first printed circuit board, wherein in the second housing at least one ground contact plate unit with a cross-shaped cross section is provided, said ground contact plate unit dividing said second housing in quadrants with a mutually equal plurality of the female contact elements in each quadrant, wherein the ground contact plate unit at the insertion side of the second housing projects from the second housing along a distance substantially corresponding with a thickness of the bottom of the first and third housings, respectively, and cross-shaped slots are provided in the bottoms of the first and third housings for receiving the ground contact plate unit, said slots dividing the bottoms of the first and third housings in quadrants with said plurality of male contact elements.

2. Connector assembly according to claim 1, wherein the first housing comprises at least one first shielding plate provided on the side walls, said shielding plate being provided with contact means for connection to a first corresponding conductor of the corresponding first printed circuit board and with first contact spring means projecting into the first housing through openings in the side walls.

3. Connector assembly according to claim 2, wherein the second housing comprises a second shielding plate extending along an upper side, side walls and a back side of the second housing, the second shielding plate having second contact means for connection to a second corresponding conductor of the corresponding second printed circuit board, said second shielding plate contacting the first contact spring means of the corresponding first shielding plate of the first housing when the assembly is coupled.

4. Connector assembly according to claim 3, wherein the side walls of the second shielding plate of the second housing are projecting, with respect to the insertion side of the second housing, along said distance.

5. Connector assembly according to claim 3, wherein said first housing has two further opposite side walls which are also provided with the at least one first shielding plate having the first contact spring means projecting into the first housing through openings in the two further side walls for contacting the side walls of the second shielding plate of the second housing.

6. Connector assembly according to claim 3, wherein the ground contact plate unit has an extension projecting at the back side of the second housing, said extension being received in a slot of the second shielding plate and being held therein.

7. Connector assembly according to claim 2, wherein each first shielding plate of the first housing has contact spring strips, each of said contact spring strips projecting into the slot in the bottom of the first housing for contacting the ground contact plate unit of the second housing.

8. Connector assembly according to claim 1 wherein the first housing is provided with a ground contact unit provided with four ground contact plates each being received in a recess adjacent to a branch of the cross-shaped slot in the first housing and each being provided with a contact means projecting into a branch of the slot for contacting the ground contact plate unit of the second housing.

9. Connector assembly according to claim 8, wherein the ground contact Unit is further provided with ground contact plates received in recesses in free bottom side edges of the first housing and each also provided with a contact means for contacting side wall parts of a second shielding plate of the second housing.

10. Connector assembly according to claim 8, wherein the ground contact unit is unitary with a first shielding plate of the first housing.

11. Connector assembly according to claim 1, wherein each male contact element comprises at least one contact pin part twisted along 90° with respect to a remaining part of the contact element.

* * * * *